US006968866B2

(12) United States Patent
Torii et al.

(10) Patent No.: US 6,968,866 B2
(45) Date of Patent: Nov. 29, 2005

(54) TENT FABRIC, TWISTED UNION YARN OF KENAF, AND PROCESS FOR PRODUCING THE SAME

(75) Inventors: Tsuyoshi Torii, Isehara (JP); Hiroshi Toyoda, Osaka (JP); Kenji Tada, Osaka (JP); Haruyoshi Kinoshita, Tenri (JP)

(73) Assignees: Taiyo Kogyo Corporation, Osaka (JP); Asahi Textile Co., Ltd., Nara (JP)

( * ) Notice: Subject to any disclaimer, the term of this patent is extended or adjusted under 35 U.S.C. 154(b) by 274 days.

(21) Appl. No.: 10/275,578

(22) PCT Filed: Oct. 4, 2001

(86) PCT No.: PCT/JP01/08767

§ 371 (c)(1),
(2), (4) Date: Nov. 7, 2002

(87) PCT Pub. No.: WO02/31243

PCT Pub. Date: Apr. 18, 2002

(65) Prior Publication Data

US 2003/0077966 A1 Apr. 24, 2003

(30) Foreign Application Priority Data

Oct. 10, 2000 (JP) ..... 2000-308791

(51) Int. Cl.[7] ..... D03D 15/02

(52) U.S. Cl. ..... 139/420 R; 139/424; 139/426; 57/238; 428/374; 428/364

(58) Field of Search ..... 139/420 R, 424, 139/426; 57/238; 428/374, 364

(56) References Cited

U.S. PATENT DOCUMENTS

| | | | | |
|---|---|---|---|---|
| 2,901,005 | A * | 8/1959 | Schwartz | 139/420 B |
| 3,347,727 | A * | 10/1967 | Emlian et al. | 57/32 |
| 3,481,132 | A * | 12/1969 | Bobkowicz et al. | 57/224 |
| 4,583,344 | A * | 4/1986 | Butler | 52/750 |
| 4,739,603 | A * | 4/1988 | Butler | 52/750 |
| 5,269,862 | A * | 12/1993 | Nakajima et al. | 156/155 |
| 6,226,972 | B1 * | 5/2001 | Kida | 57/293 |
| 6,330,786 | B1 * | 12/2001 | Settle | 57/200 |

FOREIGN PATENT DOCUMENTS

| | | |
|---|---|---|
| CN | 1117538 | 2/1996 |
| JP | 03-175031 | 7/1991 |
| JP | 04-057939 | 2/1992 |
| JP | 201-234420 | 8/2001 |
| JP | 2001-234420 | 8/2001 |

OTHER PUBLICATIONS

Ramaswamy, Cotton/Kenaf fabrics: a Viable Natural Fabric, 1999, Journal of Cotton Science 3:60-70.*
Rowell, Jute and Kenaf, 1998, Marcel Dekker, Handbook of Fiber Chemistry.*

(Continued)

*Primary Examiner*—John J. Calvert
*Assistant Examiner*—Robert H. Muromoto
(74) *Attorney, Agent, or Firm*—Rader, Fishman & Grauer PLLC

(57) ABSTRACT

A tent fabric comprising a woven fabric made of yarns containing kenaf fibers in an amount of 10 wt. % or more. The tent fabric after use can easily be recycled and hence contributes to resource saving and environmental protection.

2 Claims, 2 Drawing Sheets

OTHER PUBLICATIONS

International Search Report dated Nov. 27, 2001.
International Preliminary Examination Report mailed Nov. 27, 2002 (Japanese).
Katsuhiko Shinohara, Knowledge of Fabric, Kabushiki Kaisha Yohinkai, Jan. 10, 1978, Revised Version, pp. 74-80 (Japanese language only).
Shotara Terada, Easy-to-Understand-Guide to Fabric, Kabushiki Kaisha Seni-Kenkyusha, Dec. 10, 1979, First Edition, pp. 103-105 (Japanese language only).
Notification of Reasons for Refusal, dispatch No. 097102, dispatch date Mar. 18, 2005 (Japanese language version and English translation thereof).

* cited by examiner

TENT FABRIC, TWISTED UNION YARN OF KENAF, AND PROCESS FOR PRODUCING THE SAME

FIELD OF THE INVENTION

This invention relates to a tent fabric and twisted union yarn of kenaf, which are used for roofs of various stadiums such as dome-shaped baseball stadiums, roofs of small-sized tents used for athletic meetings, roofs and walls of incidental facilities and exhibition halls, as well as method of manufacturing the twisted union yarn of kenaf.

BACKGROUND OF THE INVENTION

As tent fabrics hitherto used for awnings for meetings used in athletic meetings, roof materials of large-sized membrane structures in expositions, or the like, fabrics made of various synthetic fiber yarns, which are coated with soft vinyl chloride resin or the like for imparting waterproofness, are generally used. Also, in order to ensure flame proofness, tent fabrics with a coating resin containing halogenated compound or the like are also used.

However, the tent fabrics made of synthetic fiber yarns are deteriorated to such an extent as to render it hard to be recycled after use, so that they tend to be burned after use. However, the tent fabrics burned may generate various chemical substances such as dioxin or poisonous gases. Therefore, they are hitherto buried in the ground as industrial wastes in many cases.

The present invention has been conceived in consideration of the above. It is an object of the present invention to provide a tent fabric that is capable of being easily recycled after use and contributing to resource saving and environmental protection.

It is another object of the present invention to provide a twisted union yarn of kenaf that contributes to production of woven fabrics with high density and high strength, which is best suited as tent fabrics, as well as provide a process for producing the same.

SUMMARY OF THE INVENTION

According to the present invention, technical means conceived to solve the above problem are in the form of a tent fabric and kenaf twisted union yarn, as well as a method of producing the same, in which the tent fabric is characterized by comprising a woven fabric made of yarns containing kenaf fibers.

The yarns contain the kenaf fibers preferably in an amount of 10 wt. % or more.

Since the tent fabric comprises kenaf fibers obtained from mallow rose family, it can easily be recycled as paper after use.

There is also provided a kenaf twisted union yarn that includes a yarn made of kenaf fibers and a yarn made of chemical fibers or natural fibers twisted with the yarn, in which the yarn made of kenaf fibers is twisted with the yarn made of chemical fibers or natural fibers with a predetermined tension force.

There is also provided a method of manufacturing a kenaf twisted union yarn that includes twisting a yarn made of kenaf fibers with a yarn made of chemical fibers or natural fibers, in which the yarn made of chemical fibers or natural fibers is fed faster than the yarn made of kenaf fibers with a predetermined tension force.

There is also provided a method of manufacturing a kenaf twisted union yarn comprising twisting a yarn made of kenaf fibers with a yarn made of chemical fibers or natural fibers, in which the feed speeds of both the yarns are controlled based upon elongation percentages thereof so that both the yarns are elongated and substantially simultaneously broken with a tension force.

As described above, the tent fabric of the present invention uses kenaf fibers for a yarn constituting the fabric, and therefore can be easily recycled as paper after use.

Accordingly, unlike a conventional tent fabric, it is not necessary to dispose of the tent fabric. Instead, it is possible to achieve recycling after use and resource saving, indirectly curbing global warming, and contribute to environmental protection.

The kenaf twisted union yarn has a stabilized thickness and strength, which improves breaking strength and smoothness of the yarn. Hence, it is possible to have a fabric with a high density and high strength, which is particularly best suited for a tent fabric.

DETAILED DESCRIPTION OF THE PREFERRED EMBODIMENTS

Figure 1:
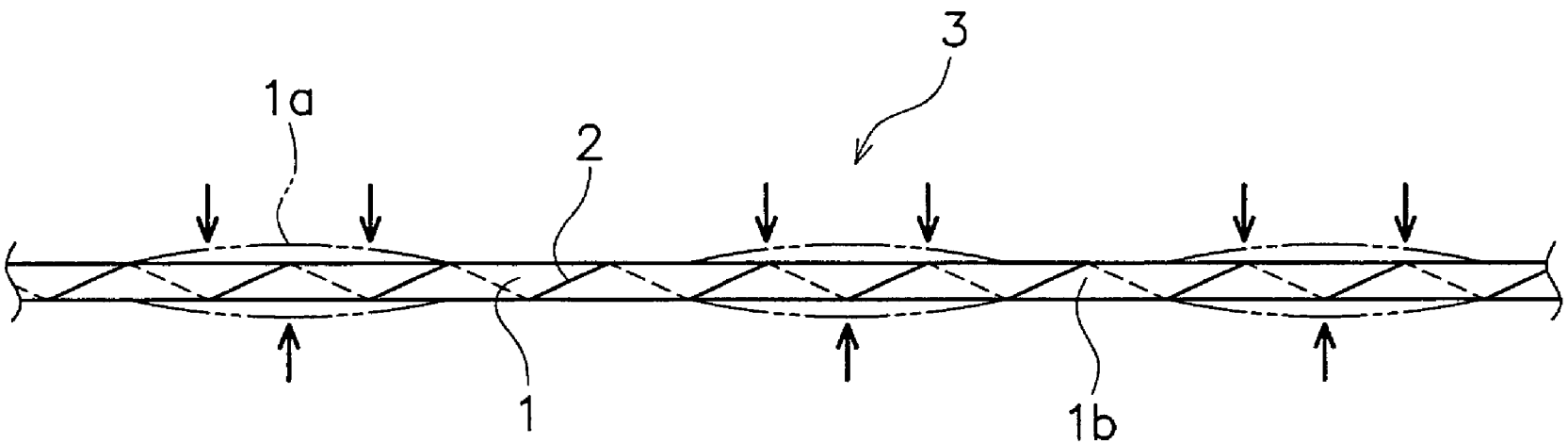
FIG. 1 is a cross sectional view of a twisted union yarn of kenaf according to one embodiment of the present invention.

An embodiment of the present invention will be hereinafter described.

The tent fabric of the present invention is made up of woven fabric, which is made of yarns containing kenaf fibers.

The kenaf fibers represent fibers obtained from kenaf (mallow rose family), and are not limited to those with a specific place of origin, so that kenaf fibers of various types can be used.

Yarns made of kenaf fibers may be those spun from kenaf fibers only (100 wt. % of kenaf) or blended with fibers other than kenaf.

As fibers other than kenaf, natural fibers such as jute and cotton, chemical fibers such as rayon, or synthetic fibers such as polyester (PET) can be used.

The mixing ratio of kenaf fibers and other fibers when using a blended yarn is not necessarily limited, but the mixing ratio of kenaf fibers is preferably set at 10 wt. % or more and more preferably 50 wt. % or more.

Yarn containing kenaf fibers can be produced according to a conventional method, which involves immersing kenaf as a raw material in water, removing bast therefrom, drying it to produce bast fibers, cutting them to a suitable length (about 50 mm), and spinning them by a spinning machine. In order to produce a blended yarn, other fibers are mixed in during spinning by the spinning machine.

The yarn produced is formed into a woven fabric according to a conventional method. The way of weaving is not necessarily limited so that a general plain fabric or twilled fabric may be employed.

As an example of woven fabric, it can be cited various fabrics such as that woven out of a yarn made only of kenaf fibers, as well as that woven out only of a blended yarn of kenaf fibers and other fibers, the yarn made only of kenaf fibers and the blended yarn, and the yarn made only of kenaf fibers and/or the blended yarn and another yarn containing no kenaf fibers.

At least one side of the woven fabric may be subjected to weather-proof treatment such as waterproof treatment and sunproof treatment, and fire and flame-proof treatment according to needs. Materials such as polyolefin, which may not cause a trouble in recycling the fabric as paper and an harmful effect are selected for these treatments.

Woven fabric containing kenaf fibers are cut into pieces having shapes suitable for such as tent fabric. Kenaf grows fast and has an excellent carbon dioxide fixation ability, so that the use of tent fabrics containing kenaf fibers can indirectly contribute to curbing global warming, and to environmental clean-up.

Also, if the tent fabric of the present invention is deteriorated due to prolonged use or cannot be used due to partial rapture or the like, it can be recycled as paper after it is recovered.

The recycling process of the tent fabric is made according to a conventional method, which involves cutting disposed tent fabric into pieces having a predetermined size, placing them into a mixer and agitating the same along with water, adding chemicals, heating the mixture, removing coarse refuse through a screen, and subjecting it to dehydration treatment by a thickener while again passing it through a screen, thereby producing recycled paper pulp. This recycled paper pulp is mixed with new pulp according to needs, and then is formed into recycled paper by a paper machine.

Now, the description will be made for a twisted union yarn which is made of a spun yarn of the kenaf fibers with or without other fibers blended therewith (kenaf yarn) and polyester yarn as a yarn of chemical fibers (pressing yarn). As illustrated in FIG. 1, kenaf yarn 1 and two ply yarn of polyester fibers (PET two-ply yarn) are twisted together, in which the feed speed (V2) of the PET two-ply yarn 2 is set faster than the feed speed (V1) of the kenaf yarn 1. Specifically, they satisfy the relationship: $1<(V2/V1)<1.1$, and more preferably $1<(V2/V1)<1.05$. The kenaf yarn 1 and the PET two-ply yarn 2 are respectively fed out at constant feed speeds and with constant tension forces to have such a twisted state as to correspond to a soft twisted yarn. The number of twisting is preferably set to e.g., about 100 times/m.

Since fibers of kenaf yarn are thicker than other natural fibers, the yarn has an unsmooth surface (as shown in phantom line in FIG. 1). Hence, the kenaf yarn has inconstant thickness and strength, and therefore cannot secure the strength if it is made of 100% kenaf. However, where the twisted union yarn is manufactured according to the above method, the PET two-ply yarn 2, which has been fed slight longer than the kenaf yarn 1, is wound around the kenaf yarn 1 with a predetermined tension force, so that thicker portion 1*a* of the kenaf yarn 1 is squeezed into a thinner shape by the PET two-ply yarn 2 with suppressing napping or fuzzing, while thinner portion 1*b* shows almost no change since the squeezing force of the PET two-ply yarn 2 applied thereover is small. Thus, twisted union yarn 3 with a substantially uniform thickness, and constant and strong strength can be manufactured.

In case of where the above twisted union yarn 3 is used as weft in forming a woven fabric, it is possible to have a woven fabric with a high strength and high density thanks to smooth running surface and suppressed napping or fuzzing. As a result, such a woven fabric is suitable as a tent fabric. Polyester yarn which has almost no unsmooth surface is preferably used as warp, but there is no necessity to use such a specific one.

The kenaf twisted union yarn 3 is also not limited to the above embodiment, but varied as described next. Specifically, while the kenaf yarn 1 and the PET two-ply yarn 2 are likewise used as previously described, the feed speeds of the respective yarns are controlled based upon their elongation percentages, thus producing a twisted yarn with high resistance against a tension force.

For example, as kenaf of the kenaf yarn and the PET yarn, a single yarn of 7*s* jute count and a two-ply yarn of 20*s* cotton count are respectively used. The elongation percentage of each yarn per unit length at break is measured. For example, where the kenaf yarn has an elongation of 5% and the PET two-ply yarn has an elongation of 15%, a smaller value is subtracted from a larger one in elongation percentage to determine a difference between these values (15−5=10%). In this embodiment, the PET two-ply yarn 2 elongates 10% greater than the kenaf yarn 1 per unit length.

Accordingly, the kenaf yarn 1 having a smaller elongation percentage is fed out at a constant speed and faster than the PET two-ply yarn 2 having a larger elongation percentage by a value corresponding to the difference (10% per unit length) and twisted with the PET two-ply yarn 2, so that both yarns are twisted together while the kenaf yarn is loosely fed. As a result, when a tension force has acted on the kenaf twisted union yarn 3, both yarns are substantially simultaneously broken, enabling the kenaf twisted union yarn to get stronger. In addition, the kenaf yarn 1 twisted with the PET two-ply yarn 2 is less roughened with napping or fuzzing suppressed.

The present invention is not necessarily limited to the above embodiment. Rather, it is possible to employ a pressing yarn that is made of, other than the PET two-ply yarn 2, such as 3 or more polyester yarns or filaments, a yarn made of natural fibers or the like.

Woven fabrics formed with the respective twisted union yarns possess high strength and high density and therefore are best suited as tent fabrics, while being usable of course as other fabrics.

EXAMPLE

Figure 2:
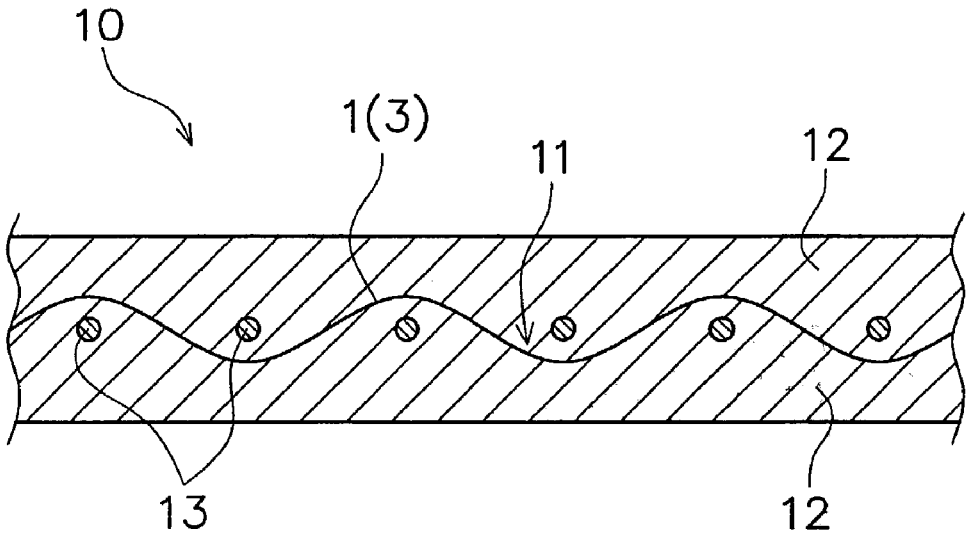
FIG. 2 is a cross sectional view of a tent fabric according to one embodiment of the present invention.

An example of the tent fabric is illustrated in FIG. 2, in which tent fabric 10 includes woven fabric (base fabric) 11 and coating layer 12 provided on the both sides of the woven fabric 11.

The base fabric 11 is comprised of a twilled fabric (2 times 2) with using polyester yarn 13 as a warp and the kenaf twisted union yarn 3 as a weft, respectively. The weight ratio between the polyester yarn and the kenaf yarn 3 is 23:73.

The base fabric 11 was coated on its both sides with EVA (ethylene-vinyl acetate copolymer).

The base fabric and the EVA respectively had weights of 403 ($g/m^2$) and 400($g/m^2$), and the tent fabric had a weight of 804($g/m^2$).

The testing as described below was conducted to extract pulp from the tent fabric 10 and recycle the same. Specifically, an alkaline digestion method was employed. A small piece of the tent fabric (500 g), water (1 liter) and sodium hydroxide (350 g) were respectively placed into a rotating autoclave of a conventional type.

While maintaining the temperature and pressure within the autoclave at 170–180° C. and at 7–8 $kgf/cm^2$, a digestion testing was conducted for 4 hours. As a result, it was found that the EVA and the polyester fibers were dissolved, while only the kenaf fibers remained. Accordingly, it became possible to extract pulp.

What is claimed is:

1. A method of manufacturing a kenaf twisted union yarn comprising twisting a yarn made of kenaf fibers with a yarn made of chemical fibers or other than kenaf fibers, in which the yarn made of chemical fibers or other than kenaf fibers is fed faster than the yarn made of kenaf fibers with a predetermined tension force.

2. A method of manufacturing a kenaf twisted union yarn comprising twisting a yarn made of kenaf fibers with a yarn made of chemical fibers or natural fibers, in which the feed speeds of both the yarns are controlled based upon elongation percentages thereof so that both the yarns are elongated and substantially simultaneously broken with a tension force.

* * * * *